US010329754B1

(12) United States Patent
Wang

(10) Patent No.: US 10,329,754 B1
(45) Date of Patent: Jun. 25, 2019

(54) TOILET PLUNGER

(71) Applicant: CHNTUO INDUSTRIAL CO., LTD., Chia-Yi (TW)

(72) Inventor: Jung-Shih Wang, Chia-Yi (TW)

(73) Assignee: Chntuo Industrial Co., Ltd., Chia-Yi (TW)

( * ) Notice: Subject to any disclaimer, the term of this patent is extended or adjusted under 35 U.S.C. 154(b) by 0 days.

(21) Appl. No.: 15/972,451

(22) Filed: May 7, 2018

(51) Int. Cl.
*E03C 1/308* (2006.01)

(52) U.S. Cl.
CPC ..... *E03C 1/308* (2013.01)

(58) Field of Classification Search
CPC ..... E03C 1/308
USPC ..... 4/255.01–255.12
See application file for complete search history.

(56) References Cited

U.S. PATENT DOCUMENTS

2006/0096060 A1* 5/2006 Zhang ..... B08B 9/055 15/406
2013/0061378 A1* 3/2013 Kihs ..... E03C 1/304 4/255.01
2013/0198943 A1* 8/2013 Park ..... E03C 1/304 4/255.04
2015/0074889 A1* 3/2015 Donohue ..... E03C 1/304 4/255.06
2018/0133763 A1* 5/2018 Kehoe ..... B05B 1/005

* cited by examiner

*Primary Examiner* — Christine J Skubinna
(74) *Attorney, Agent, or Firm* — Rosenberg, Klein & Lee

(57) ABSTRACT

A toilet plunger is disclosed. It comprises a main body having an assembly groove, an air duct communicated with the assembly groove, a handle mounted at a back side thereof, and a penetration hole; a cup connected to a front side of the main body and communicated with the assembly groove by the air duct; an accommodation apparatus having a long slot for connecting a joint axis of the assembly groove pivotally and movably and assembling to the assembly groove, and an accommodation groove for accommodating a gas container; a trigger pivotally connecting the handle and having an elastic resetting element disposed between the trigger and the handle; and a pushing rod inserted into the penetration hole and having a pushing portion corresponding to the assembly groove, an elastic member disposed between the pushing portion and the main body, and a pulling portion.

9 Claims, 7 Drawing Sheets

TOILET PLUNGER

BACKGROUND OF THE INVENTION

1. Field of the Invention

The present invention relates to a toilet plunger which has a new designed structure to improve its whole practical feature and facilitate the replacement or installation of a gas container.

2. Description of Related Art

When a pipe or a toilet is plugged up, a toilet plunger is used to unclog the pipe or the toilet. A traditional toilet plunger comprises a handle connected with a bowl-shaped rubber adsorption cup at a bottom of the handle. When the rubber adsorption cup is pressed against the toilet by a user applying a force on the handle, the pressure inside the rubber adsorption cup is altered by repeated suction and thrust so that a plugged region can be cleared. However, the traditional toilet plunger cannot clear a plugged toilet efficiently since the pressure alternation generated by repeated pressing the rubber adsorption cup against the toilet is limited. Even though objects plugged in the toilet can be stirred by the pressure alternation generated by the rubber adsorption cup of the traditional toilet plunger, the toilet is easily plugged by these objects again.

The China Pat. No. CN104080383(B), issued on 15 Feb. 2017, disclosed a toilet purging apparatus, comprises a pipe body having a longitudinally movable gas channel through the pipe body; a firing unit having a firing pin and a switch coupled to an upper end of the pipe body for moving the firing pin to the pipe body when being pressed; a tightening cap that screwed to the top of the firing unit, a gas container disposed between the firing unit and the tightening cap for moving the gas container to contact the firing pin closely when being turned; and a connector coupled to the lower end of the pipe body and inserted into a drain pipe of a toilet.

The toilet purging apparatus described above achieves an expected effect of clearing the toilet efficiently, but it is not convenient enough in use. In replacing the gas container, the tightening cap must be unscrewed from the firing unit first and then screwed to the firing unit again after replacing or installation the gas container, so the structure of the toilet purging apparatus still needs to be improved.

SUMMARY OF THE INVENTION

The present invention relates to a toilet plunger which has a new designed structure to improve its whole practical feature and facilitate the replacement or installation of a gas container.

The main purpose and effects of the toilet plunger of the present invention are disclosed by the following features.

The toilet plunger of the present invention comprises a main body, a cup, an accommodation apparatus, a trigger and a pushing rod.

The main body has an assembly groove, an air duct communicated with the assembly groove, a penetration hole bored at a back side of the main body and a handle mounted at a back side of the main body. The assembly groove is provided with a joint axis, and the air duct is provided with a pin is corresponding to the assembly groove.

The cup having an outlet is connected to a front side of the main body and communicated with the assembly groove by the air duct.

The accommodation apparatus comprises a long slot corresponding to the joint axis for pivotally and movably connecting the joint axis and downwards assembling to the assembly groove, and an accommodation groove to accommodate a gas container. The accommodation groove is provided with a through hole corresponding to the pin of the air duct for an insertion of a tip of the pin.

The trigger is connected to the handle pivotally and provided with an elastic resetting element disposed between the trigger and the handle, and a supporting portion disposed on an upper region of the trigger and corresponding to the assembly groove.

The pushing rod is inserted into the assembly groove through the penetration hole. The pushing rod is provided with a pushing portion at one end of the pushing rod corresponding to the assembly groove and supported by the supporting portion of the trigger for positioning, an elastic member disposed between the pushing portion and the main body, and a pulling portion connected to the other end of the pushing rod.

According to an embodiment of the present invention, the cup is extended with a protruding portion in which the outlet is bored at a front end thereof and communicated with the air duct through the assembly groove.

According to an embodiment of the present invention, the assembly groove of the main body is provided with a positioning member, and the accommodation apparatus is provided with a positioning hole corresponding to the positioning member for positioning.

According to an embodiment of the present invention, the assembly groove of the main body is provided with two concaved portions at two sides thereof corresponding to the accommodation apparatus for lifting the accommodation apparatus from the assembly groove conveniently.

According to an embodiment of the present invention, a lateral of the main body is provided with a side handle for holding by a user conveniently.

According to an embodiment of the present invention, the accommodation groove is provided with a fixing sheath for fixing and sealing the gas container.

According to an embodiment of the present invention, the fixing sheath is made of a soft material.

According to an embodiment of the present invention, the supporting portion of the trigger is a pulley or a bearing.

According to an embodiment of the present invention, a storage seat having a storage space is further provided for storing and positioning the main body and the cup connected to the front side of the main body.

DETAILED DESCRIPTION OF THE PREFERRED EMBODIMENT

Figure 1:
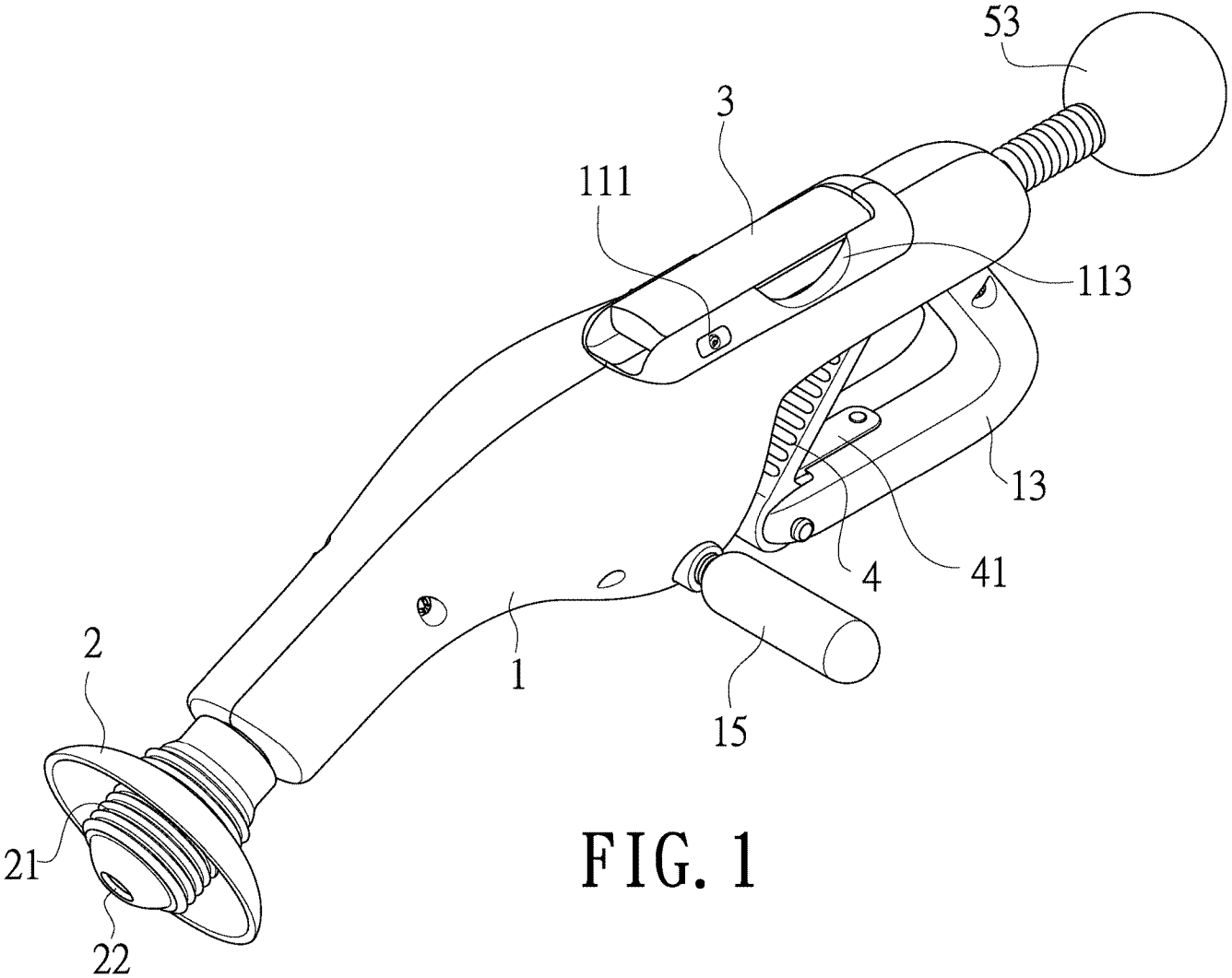
FIG. 1 is a stereogram showing a toilet plunger of the present invention.
Figure 2:
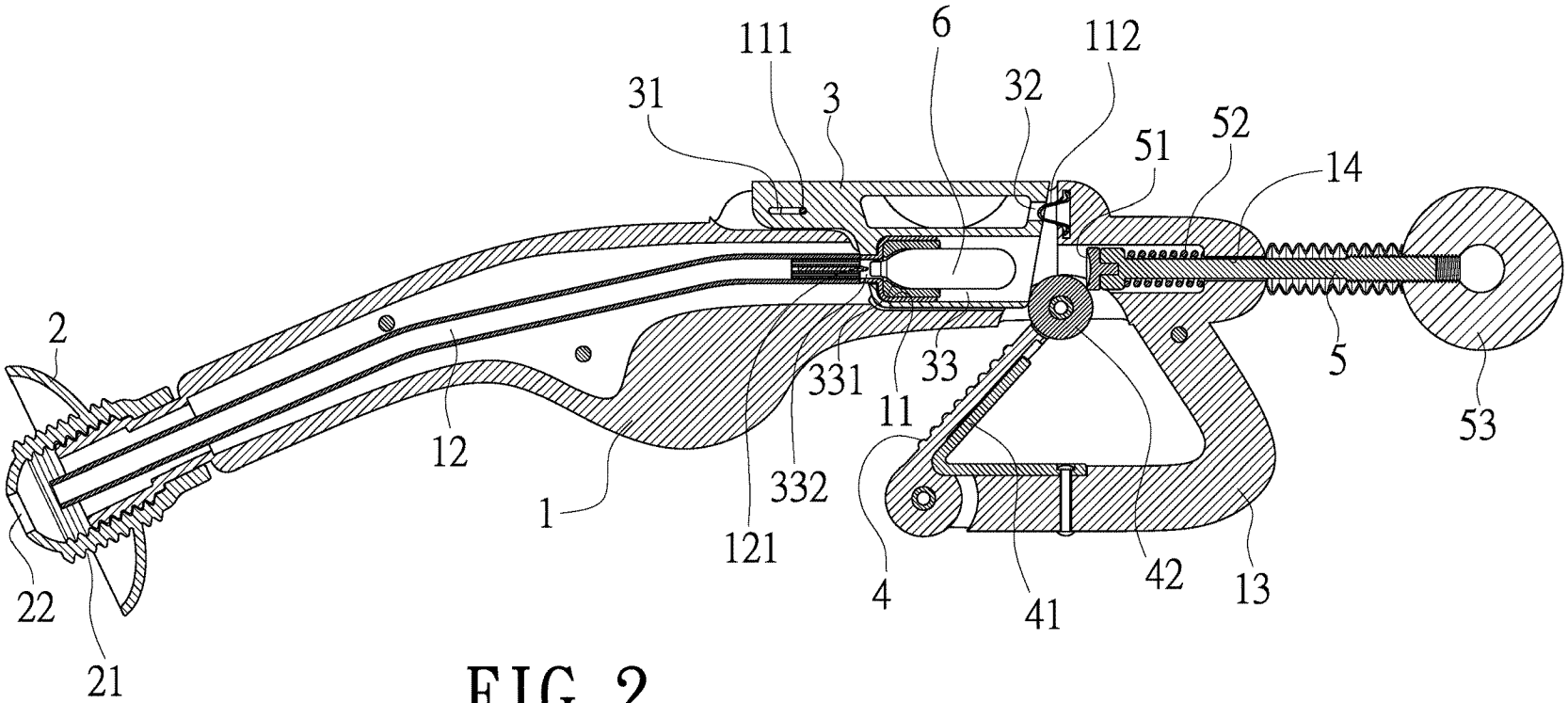
FIG. 2 is a section view showing a toilet plunger of the present invention.
Figure 3:
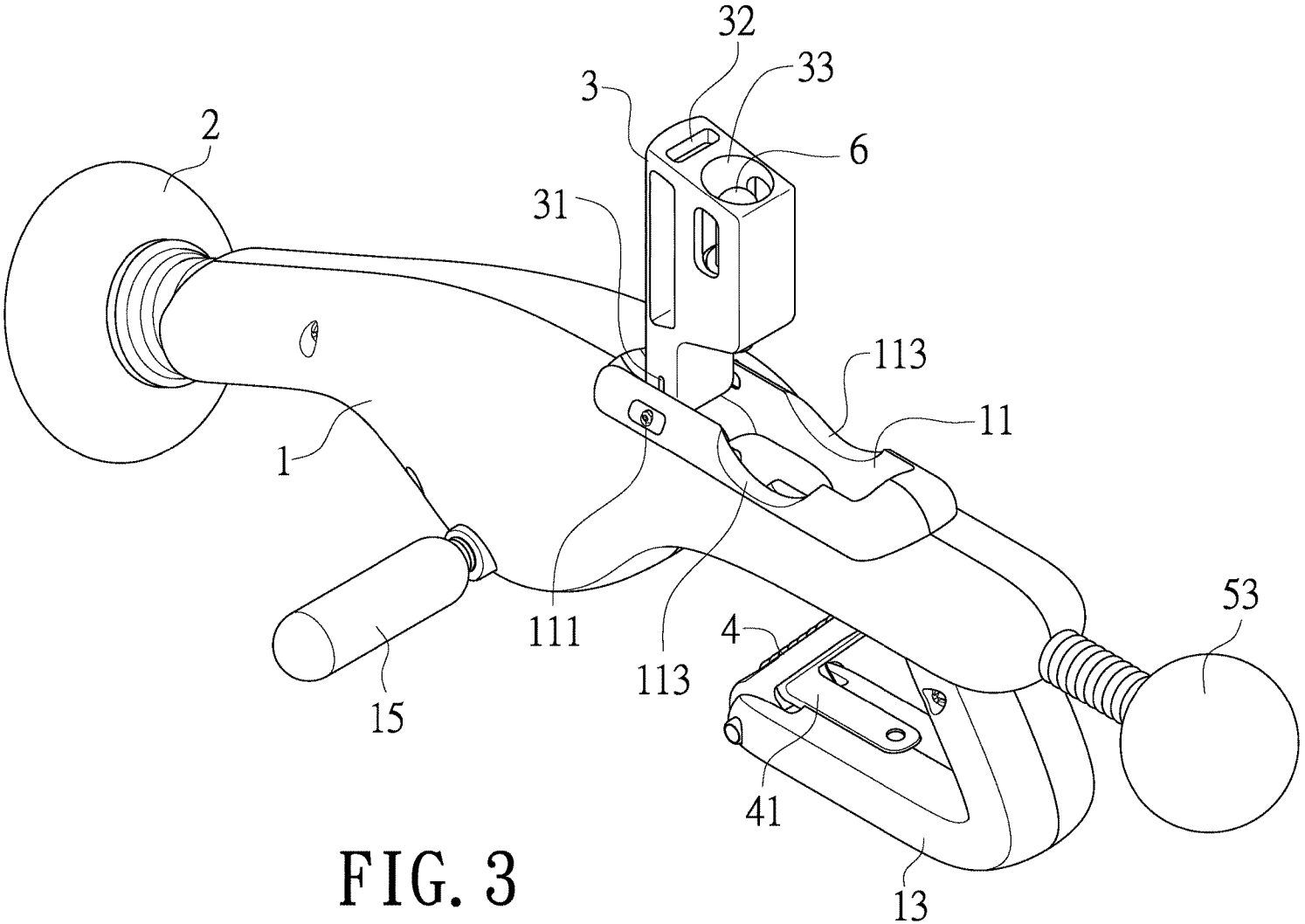
FIG. 3 is a stereogram showing an opening state of an accommodation apparatus of the present invention.
Figure 4:
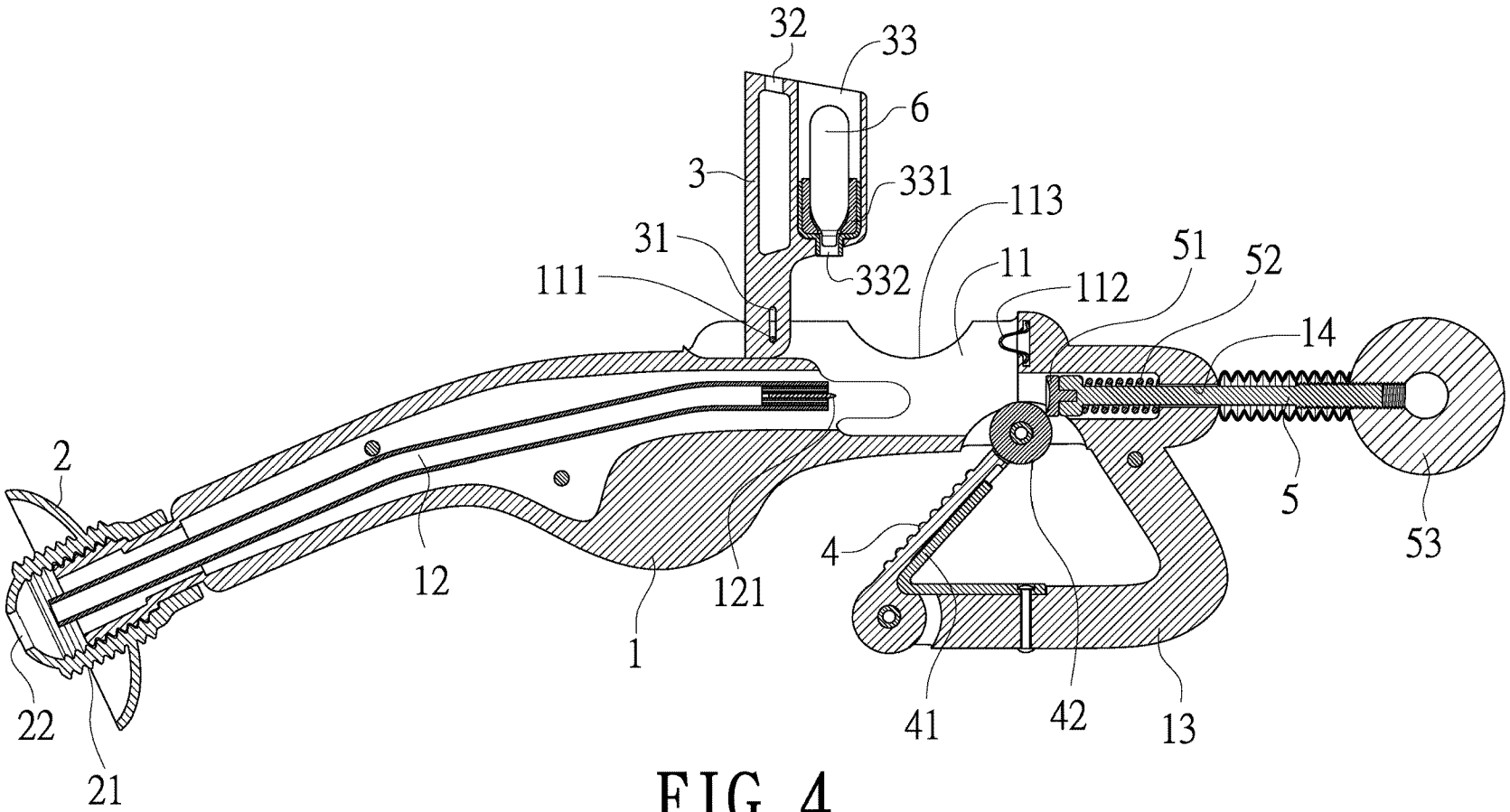
FIG. 4 is a section view showing an opening state of an accommodation apparatus of the present invention.

To provide a thorough understanding, the purpose and advantages of the present invention will be described in detail with reference to the accompanying drawings.

Referring to FIG. 1, FIG. 2, FIG. 3 and FIG. 4, a stereogram of the present invention, a structural sectional view of the present invention, a stereogram showing an opening state of an accommodation apparatus of the present invention, and a sectional view showing an opening state of an accommodation apparatus of the present invention are disclosed respectively. The toilet plunger of the present invention comprises a main body (1), a cup (2), an accommodation apparatus (3), a trigger (4) and a pushing rod (5).

The cup (2) is connected to a front side of the main body (1) extended with a protruding portion (21) in which an outlet (22) is bored at a front end of the protruding portion (21). The main body (1) has an assembly groove (11) which is communicated with the protruding portion (21) by an air duct (12). The air duct (12) is provided with a pin (121) corresponding to the assembly groove (11). The assembly groove (11) is provided with a joint axis (111), and the accommodation apparatus (3) has a long slot (31) corresponding to the joint axis (111) for pivotally and movably connecting the joint axis (111) and downwards assembling to or upwards lifting from the assembly groove (11). The assembly groove (11) of the main body (1) is provided with a positioning member (112), and the accommodation apparatus (3) is provided with a positioning hole (32) corresponding to the positioning member (112) for positioning. The assembly groove (11) is provided with two concaved portions (113) at two sides corresponding to the accommodation apparatus (3). The accommodation apparatus (3) is provided with an accommodation groove (33) for accommodation a gas container (6) and the accommodation groove (33) is provided with a fixing sheath (331) made of a soft material for fixing and sealing the gas container (6). The accommodation groove (33) has a through hole (332) corresponding to the pin (121) of the air duct (12) for an insertion of a tip of the pin (121). A back side of the main body (1) is provided with a handle (13) which is pivotally connected to the trigger (4) and an elastic resetting element (41) is disposed between the trigger (4) and the handle (13). The trigger (4) has a supporting portion (42) disposed on an upper region corresponding to the assembly groove (11), the supporting portion (42) is a pulley or a bearing. The main body (1) communicates with the assembly groove (11) by a penetration hole (14) bored at a back side, and the pushing rod (5) is inserted into the assembly groove (11) through the penetration hole (14). The pushing rod (5) is provided with a pushing portion (51) at one end corresponding to the assembly groove (11). The pushing portion (51) is supported by the supporting portion (42) of the trigger (4) for positioning. The pushing portion (51) is provided with an elastic member (52) disposed between the pushing portion (51) and the main body (1). The pushing portion (51) is further provided with a pulling portion (53) connected to the other end of the pushing portion (51), and a lateral of the main body (1) is provided with a side handle (15) for holding by a user conveniently.

Figure 5:
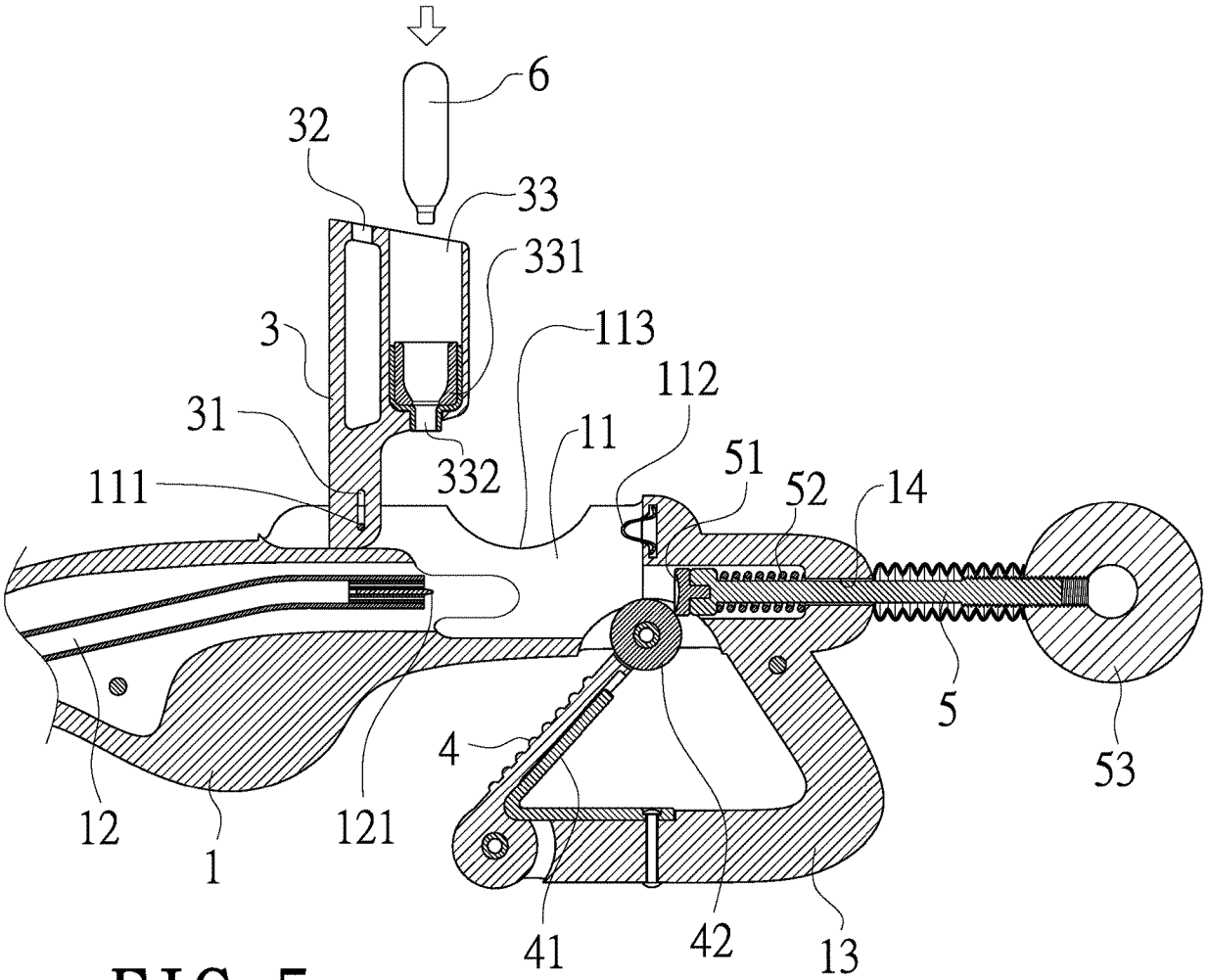
FIG. 5 is a schematic diagram showing a gas container assembled to a toilet plunger of the present invention.
Figure 6:
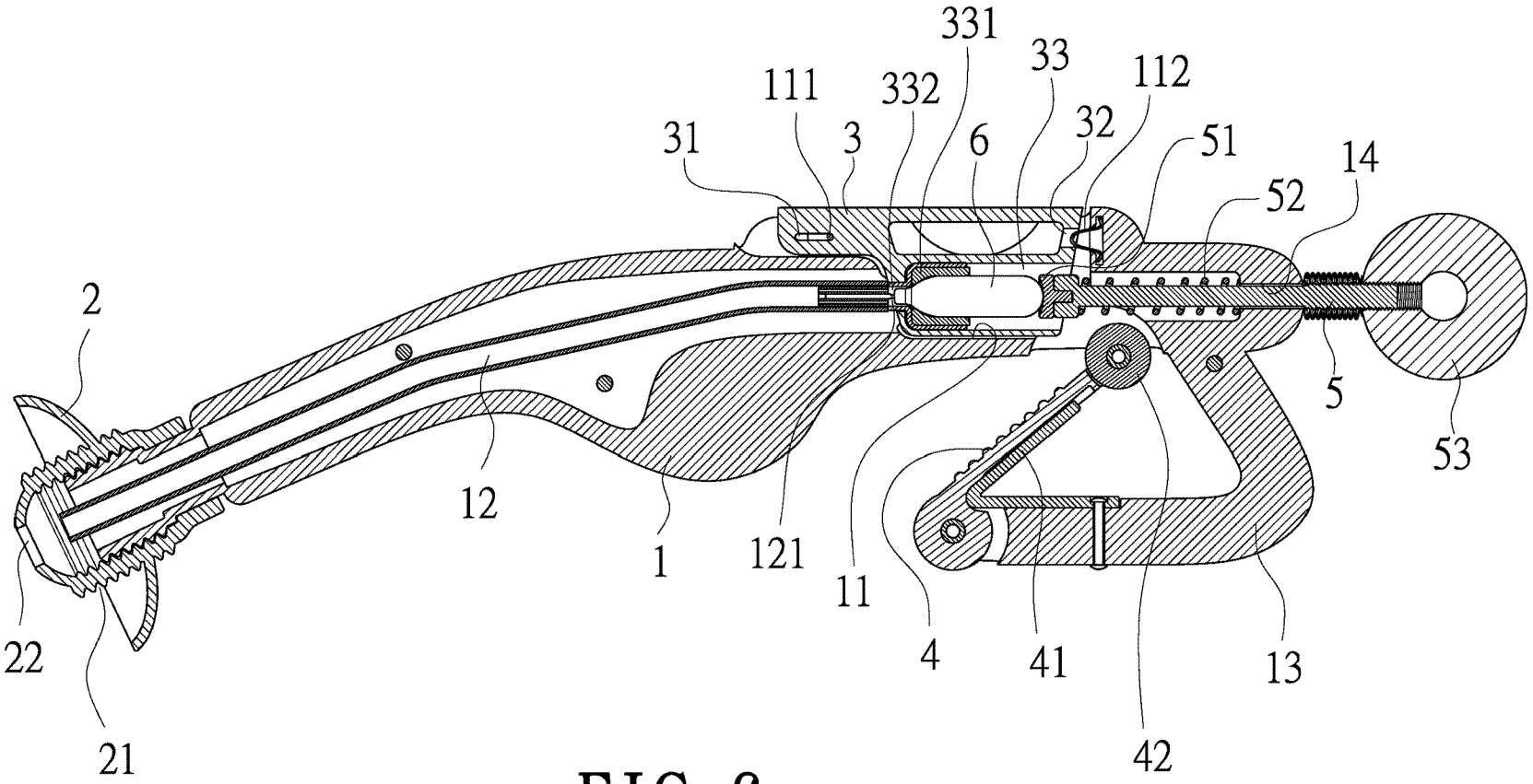
FIG. 6 is a section view showing a usage state of the present invention in use.

Referring to FIG. 5, a schematic diagram showing a gas container assembled to a toilet plunger of the present invention is disclosed. The pushing rod (5) is pulled out of the main body (1) by the pulling portion (53), and the trigger (4) is driven by a resilience of the elastic resetting element (41) to make the supporting portion (42) support and position the pushing portion (51), and the accommodation apparatus (3) is then upwards lifted from the assembly groove (11) of the main body (1). Since the assembly groove (11) are provided with two concaved portions (113) at two sides corresponding to the accommodation apparatus (3), the accommodation apparatus (3) can be conveniently lifted by a user through the two concaved portions (113), the gas container (6) is inserted into the accommodation groove (33) of the accommodation apparatus (3), and then the accommodation apparatus (3) is downwards assembled into the assembly groove (11). The positioning member (112) of the assembly groove (11) is embedded into the positioning hole (32) of the accommodation apparatus (3) for positioning. To unclog a plugged toilet or pipe, the plugged toilet or pipe is covered by the cup (2) and the protruding portion (21) of the cup (2) is inserted into the plugged toilet or the pipe; the trigger (4) is pressed to release the pushing portion (51) of the pushing rod (5) from the supporting portion (42) of the trigger (4). The supporting portion (42) is pulley or a bearing for conveniently releasing the pushing portion (51) form the supporting portion (42) when pressing the trigger (4). After releasing from the supporting portion (42), the pushing portion (51) is pushed to the gas container (6) by a resilience of the elastic member (52), and the gas container (6) is then driven to the pin (121) of the air duct (12). Please referring to FIG. 6, the gas container (6) is pierced by the pin (121) and the gas in the gas container (6) is spurted from the air duct (12) to the outlet (22) of the cup (2) for unclogging the plugged toilet or pipe.

Figure 7:
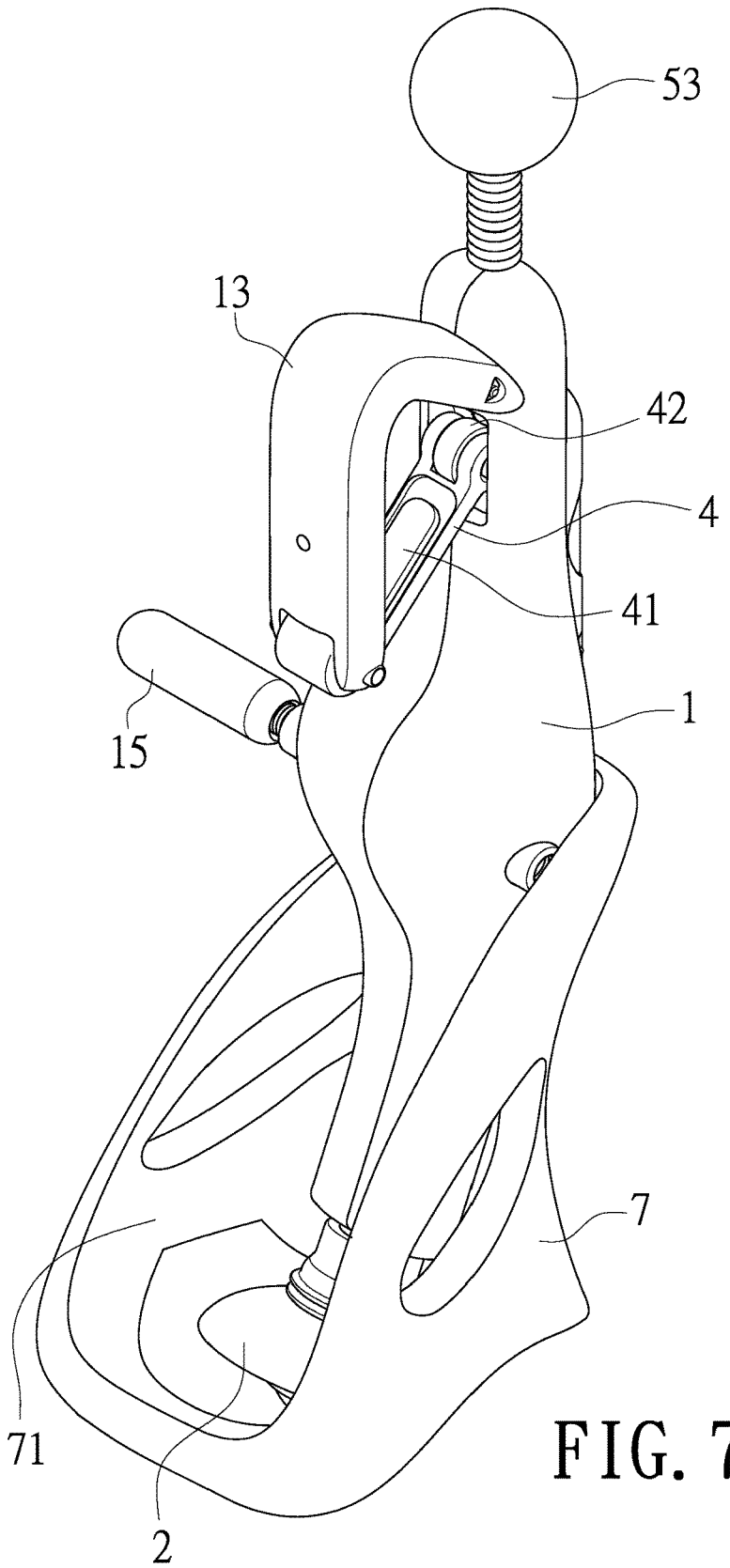
FIG. 7 is a schematic diagram showing a toilet plunger accommodated in a storage seat according to the present invention.

Please referring to FIG. 7, the present invention further comprises a storage seat (7). The storage seat (7) has a storage space (71) for storing and positioning the main body (1) and the cup (2) connected to the front side of main body (1).

As the structures and embodiments described above, the toilet plunger of the present invention is convenient in use compared to the toilet plunger available now. The present invention not only improves its whole practical feature but also facilitates the replacement or installation of a gas container and improves its whole practical feature in use.

What is claimed is:

1. A toilet plunger, comprising:

a main body having an assembly groove, an air duct communicated with the assembly groove, a handle mounted at the back side thereof, and a penetration hole bored at a back side of the main body, wherein the assembly groove is provided with a joint axis and the air duct is provided with a pin corresponding to the assembly groove;

a cup connected to a front side of the main body and having an outlet, wherein the cup is communicated with the assembly groove by the air duct;

an accommodation apparatus having a long slot corresponding to the joint axis for pivotally and movably connecting the joint axis and downwards assembling to the assembly groove, and an accommodation groove for accommodating a gas container and having a through hole corresponding to the pin of the air duct for an insertion of a tip of the pin;

a trigger pivotally connected to the handle and having an elastic resetting element disposed between the trigger and the handle, and a supporting portion disposed on an upper region thereof and corresponding to the assembly groove; and a pushing rod inserted into the assembly groove through the penetration hole and having a pushing portion at one end thereof corresponding to the assembly groove and supported by the supporting portion of the trigger for positioning, an elastic member disposed between the pushing portion and the main body, and a pulling portion connected to the other end thereof.

2. The toilet plunger as claimed in claim 1, wherein the cup is provided with a protruding portion in which the outlet is bored at a front end thereof and communicated with the air duct through the assembly groove.

3. The toilet plunger as claimed in claim 1, wherein the assembly groove of the main body is provided with a positioning member, and the accommodation apparatus is provided with a positioning hole corresponding to the positioning member for positioning.

4. The toilet plunger as claimed in claim 1, wherein the assembly groove of the main body is provided with two concaved portions at two sides thereof corresponding to the accommodation apparatus for lifting the accommodation apparatus from the assembly groove conveniently.

5. The toilet plunger as claimed in claim 1, wherein a lateral of the main body is provided with a side handle for holding by a user conveniently.

6. The toilet plunger claimed in claim 1, wherein the accommodation groove is provided with a fixing sheath for fixing and sealing the gas container.

7. The toilet plunger as claimed in claim 6, wherein the fixing sheath is made of a soft material.

8. The toilet plunger as claimed in claim 1, wherein the supporting portion of the trigger is a pulley or a bearing.

9. The toilet plunger as claimed in claim 1, further comprising a storage seat having a storage space for storing and positioning the main body and the cup connected to the front side of the main body.

* * * * *